US006896043B2

(12) United States Patent
Dunn

(10) Patent No.: US 6,896,043 B2
(45) Date of Patent: May 24, 2005

(54) HEAT EXCHANGER

(75) Inventor: Matthew Dunn, Wading River, NY (US)

(73) Assignee: Telephonics Corporation, Farmingdale, NY (US)

( * ) Notice: Subject to any disclaimer, the term of this patent is extended or adjusted under 35 U.S.C. 154(b) by 27 days.

(21) Appl. No.: 10/091,115

(22) Filed: Mar. 5, 2002

(65) Prior Publication Data

US 2003/0168210 A1 Sep. 11, 2003

(51) Int. Cl.[7] ..... F28D 9/00
(52) U.S. Cl. ..... 165/165
(58) Field of Search ..... 165/164, 165, 165/DIG. 399

(56) References Cited

U.S. PATENT DOCUMENTS 1,597,678 A * 8/1926 Fisher ..... 165/159
1,601,637 A * 9/1926 Meigs ..... 165/166
3,552,488 A * 1/1971 Grill et al. ..... 165/166
3,829,945 A * 8/1974 Kanzler et al. ..... 29/890.03
4,131,159 A * 12/1978 Long ..... 165/166
4,384,611 A * 5/1983 Fung ..... 165/166
4,556,105 A * 12/1985 Boner ..... 165/165
4,729,427 A * 3/1988 Baumann ..... 165/165

FOREIGN PATENT DOCUMENTS

CA 501932 A * 4/1954 ..... 165/165

* cited by examiner

*Primary Examiner*—Allen J. Flanigan
(74) *Attorney, Agent, or Firm*—Bodner & O'Rourke; Thomas A. O'Rourke

(57) ABSTRACT

An improved counterflow heat exchanger is described. The heat exchanger has one or more cold air intake passageways and one or more hot air intake passageways wherein the flow of cold air is opposite the flow of hot air. In addition, each cold air intake passageway contacts at least one hot air intake passage way.

12 Claims, 6 Drawing Sheets

HEAT EXCHANGER

FIELD OF INVENTION

The present invention relates to improved heat exchangers that may be used in a variety of applications.

BACKGROUND OF THE INVENTION

When a solid, liquid or gas has to be heated up or cooled down a heat exchanger is used. In a heat exchanger a hot fluid (e.g. hot water, steam or air, etc.) is used to heat a cooler fluid. The two fluids will be separated by some physical barrier, such as, a tube, a wall or a metal plate. The aim of a heat exchanger designer is to make sure that the area of the tube, walls or metal plate is large enough for the required amount of heat to be transferred from the hot fluid to the cold fluid. The performance of a heat exchanger will normally be specified in terms of the inlet and outlet temperatures of one of the two streams entering the exchanger. The amount of heat that has to be transferred between fluid streams is called the heat load. Thus, heat exchangers are devices designed to accomplish efficient heat transfer from one fluid to another and are widely used in engineering processes. Some examples are intercoolers, preheaters, boilers and condensers in power plants. The first law of thermodynamics is generally applicable to a heat exchanger working at steady-state condition and operates in accordance with the following formula:

$$\Sigma mi\Delta hi=0$$

where, mi=mass flow of the i-th fluid and
Δhi=change of specific enthalpy of the i-th fluid There are several types of heat exchangers typically available. One type of heat exchanger is the recuperative type, in which fluids exchange heat on either side of a dividing wall. A second type of heat exchanger is the regenerative type, in which hot and cold fluids occupy the same space containing a matrix of material that works alternatively as a sink or source for heat flow. A third type of heat exchanger is the evaporative type, such as cooling tower in which a liquid is cooled evaporatively in the same space as coolant.

The recuperative type of heat exchanger is the most common heat exchanger in practice and the design is usually of one of the following types:

Parallel-Flow Heat Exchanger

A parallel flow heat exchanger usually has a fluid flowing through a pipe and exchanges heat with another fluid through an annulus surrounding the pipe. In a parallel-flow heat exchanger fluids flow in the same direction. If the specific heat capacity of fluids are constant, it can be shown that:

$$dQ/dt=UA\Delta T$$

where,
dQ/dt=Rate of heat transfer between two fluids
U=Overall heat transfer coefficient
A=Area of the tube
ΔT=Logarithmic mean temperature difference defined by:

$$\Delta T=(\Delta T_1-\Delta T_2)/ln(\Delta T_1/\Delta T_2)$$

Cross-Flow Heat Exchanger

In a cross-flow heat exchanger the direction of fluids are perpendicular to each other. The required surface area, Across for this heat exchanger is usually calculated by using tables. It is between the required surface area for counter-flow, Acounter and parallel-flow, Aparallel i.e.

$$Acounter<Across<Aparallel$$

Counter-Flow Heat Exchanger

In a counter-flow heat exchanger a fluid typically flows through a pipe and exchanges heat with another fluid through an annulus surrounding the pipe. In a counter-flow heat exchanger fluids flow in the opposite direction. If the specific heat capacity of fluids are constant, it can be shown that:

$$dQ/dt=UA\Delta T$$

where,
dQ/dt=Rate of heat transfer between two fluids
U=Overall heat transfer coefficient
A=Area of the tube
ΔT=Logarithmic mean temperature difference defined by:

$$\Delta T=(\Delta T_1-\Delta T_2)/ln(\Delta T_1/\Delta T_2)$$

OBJECTS OF THE INVENTION

It is an object of the invention to provide an improved heat exchanger that is more thermodynamically efficient than prior heat exchangers.

It is an object of the present invention to provide an improved counterflow heat exchanger.

It is an object of the present invention to provide an improved heat exchanger that may be used to supply cool air for the thermal management of electronic equipment.

It is an object of the present invention to provide an improved heat exchanger that provides increased system performance and reliability without increasing weight, air-flow pressure head, or size allocations of the heat exchanger.

SUMMARY OF THE INVENTION

In addition, the weight of the heat exchanger is reduced by removing the joiner plates. In some applications this reduction in weight can be particularly advantageous. In others such as aircraft, the weight reduction is negligible but still important.

The benefits of the improved heat exchanger of the present invention are achieved by a one or more corrugated passages where apposing airflow is directed into alternating channels or ducts created by the corrugated finned material. In the present invention, the apposing airflows are separated by only the thickness of the finned material, not the separator plate as is the case in the prior art heat exchangers. Heat is now conducted through the fin thickness rather than the fin length. Since this is a single passage design, the manufacturing costs of stacking up multiple passages, is avoided.

The heat exchanger of the present invention has a high aspect ratio of the height to the width for the corrugated fin compared to the prior art. The aspect ratio is at least 10:1, preferably 15:1, more preferably 20:1 and most preferably 25:1 for the corrugated fin compared to the prior art. The present invention also greatly reduces the conduction losses that are associated with the long effective fin established in a multi-stage design. The heat exchanger of the present invention can be either a single or multi stage device.

DETAILED DESCRIPTION OF THE INVENTION

Figures 1, 2:
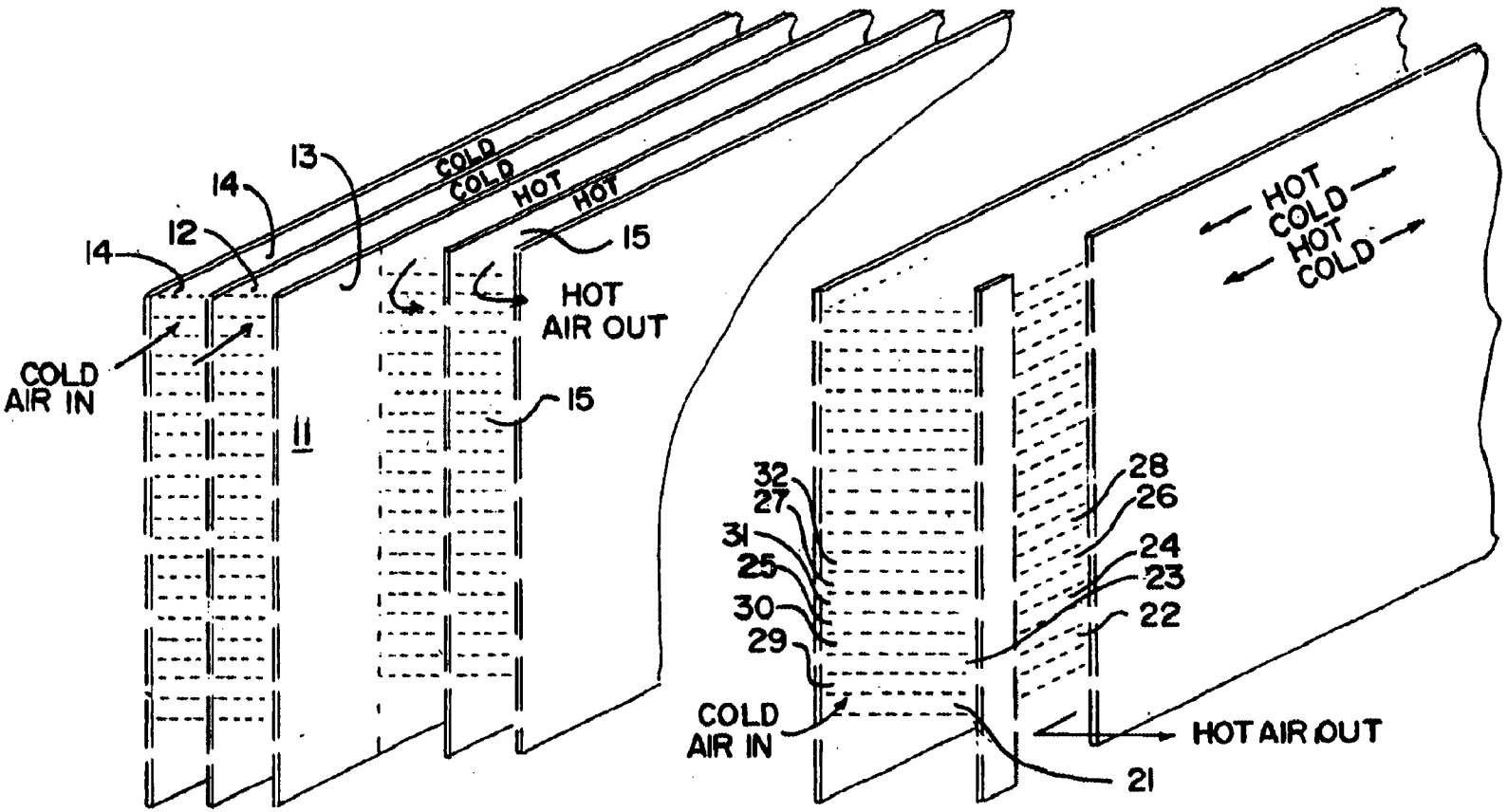
FIG. 1 is an example of a prior art conventional multi-passage counterflow heat exchanger.
FIG. 2 is a representation of a single passage counterflow heat exchanger of the present invention.

As seen in FIG. 1, there is shown a conventional counterflow heat exchanger 10. This conventional heat exchanger has a separator plate 11 that separates the first cold air portion 12 from the first hot air portion 13. There can be additional cold air portions 14 on the first cold air portion 12 and additional hot air portions 15 on the first hot air portion 13. The heat exchanger has a plurality of cold air passages 14 and a plurality of hot air passages 15. Conventional counterflow compact heat exchangers typically employ multiple passages of apposing airflow of different temperatures to create a thermal heat transfer from the hotter airflow to the cooler airflow. Each passage is usually made of a corrugated fin material sandwiched between flat sheets creating a series of ducts for air to flow. Multiple passages are usually stacked on top of one another and share intermediate "joiner" plates 11A. The separator plate divides the hot/cold passages and supports the finned material. Conventionally, heat transfer is conducted down the hot air fin, through the hot/cold separator plate and up the opposite cold air fin. Since the height of the fin is perpendicular to the separator plate, increasing the fin height reduces the fin efficiency due to its increased conductive length i.e., the distance from the separator plate. Manufacturing costs rise with the number of passages required, to the point where it becomes impractical to specify more than a few passages.

Figure 3:
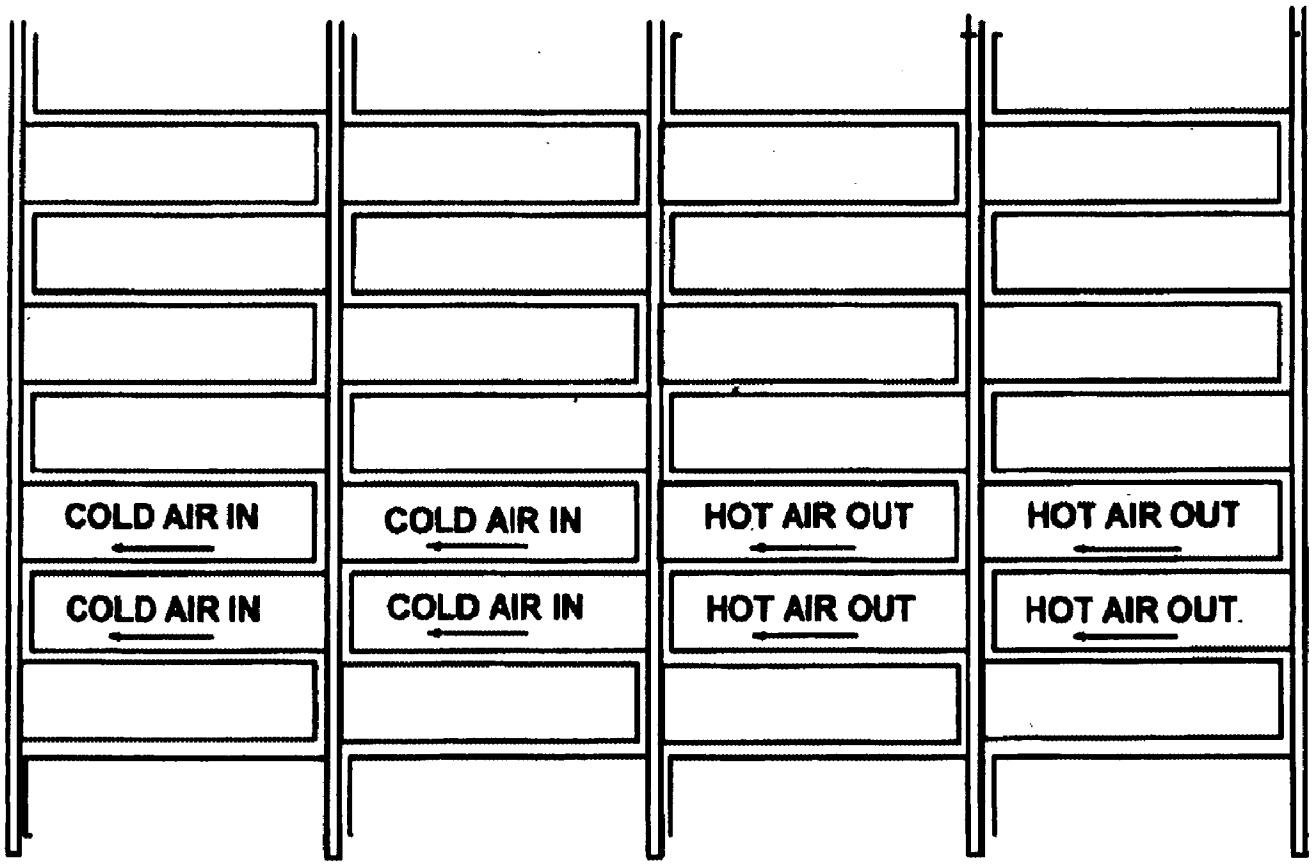
FIG. 3 shows a cross section of a prior art, multi-stage (4. stage) counterflow heat exchanger.
Figure 4:
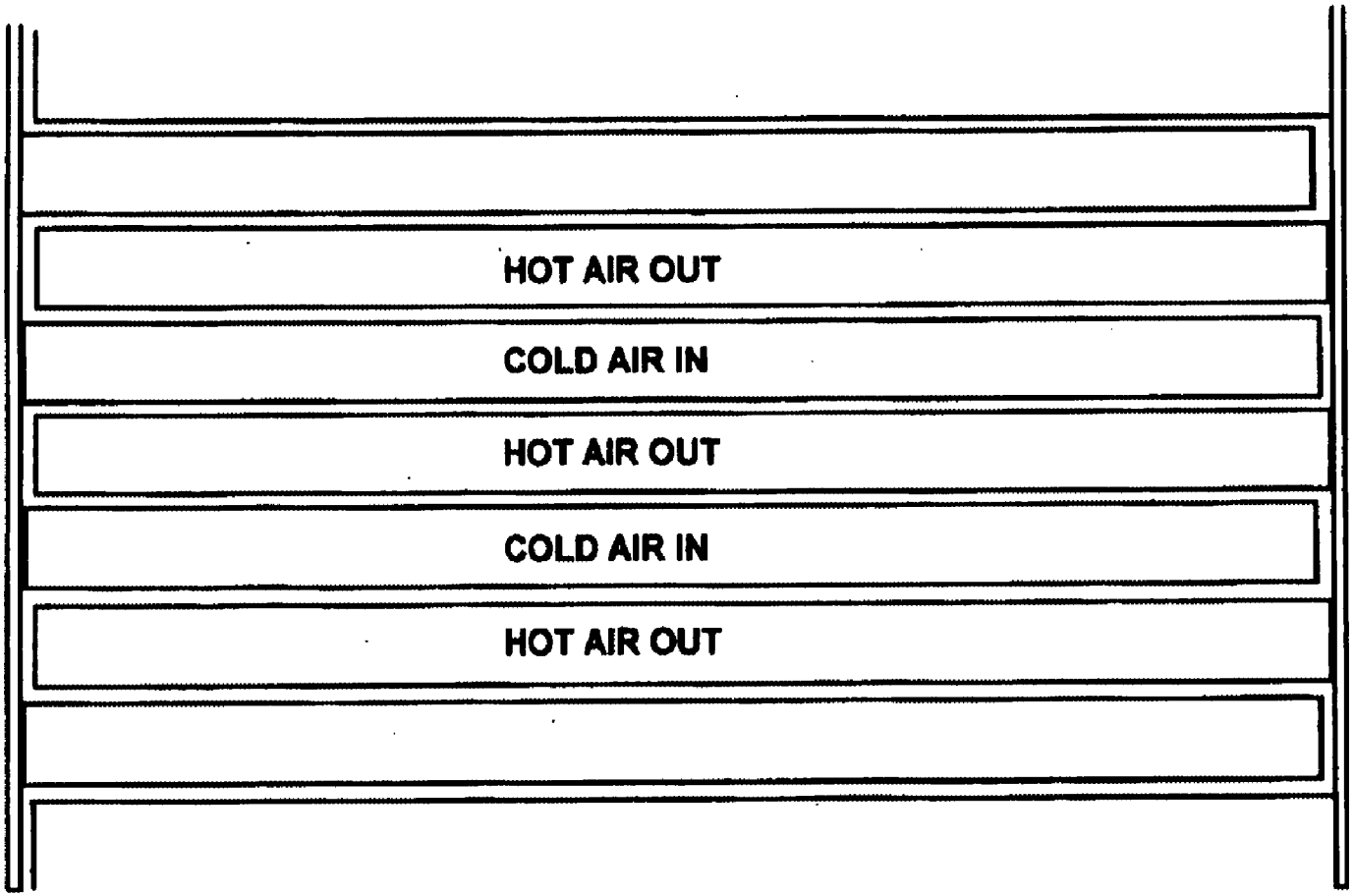
FIG. 4 shows a cross section of the single-stage counterflow heat exchanger of the present invention.

FIG. 3 shows a cross-section of a prior art multi-stage counterflow heat exchanger. In this instance, the heat exchanger is a 4 stage heat exchanger. In the heat exchanger of FIG. 3 the direction of conductive heat transfer is along the height of the fins. This is in comparison to the heat exchanger of the present invention shown in FIG. 4. The heat exchanger shown in FIG. 4 is a single stage counterflow heat exchanger. The direction of the conductive heat transfer in the heat exchanger of FIG. 4 is across the thickness of the fin. The differences in effective fin heights are demonstrated in the Figures.

The heat exchanger of the present invention is shown in FIG. 2. As seen in FIG. 2 there are cold air in passageways 21, 23, 25, 27, etc. These passageways are separated by the hot air passageways 22, 24, 26, 28, etc. The hot air can be exhausted perpendicular to the flow of the cold air into the heat exchanger. This can be accomplished by a series of blockage 29, 30, 31, 32, etc., that direct the flow of the hot air out thru an opening in the side wall. The capacity of the heat exchanger of the present invention can be increased without degrading efficiency by increasing the number of passages. Since the additional passages are not at a greater distance from a separator plate, there is no risk that the additional passages will lack thermal efficiency. As each hot air passage typically has a cold air passage on each side thereof in the heat exchanger.

FIG. 3 shows a cross-section of a prior art multi-stage counterflow heat exchanger. In this instance, the heat exchanger is a 4 stage heat exchanger. In the heat exchanger of FIG. 3 the direction of conductive heat transfer is along the height of the fins. This is in comparison to the heat exchanger of the present invention shown in FIG. 4. The heat exchanger shown in FIG. 4 is a single stage counterflow heat exchanger. The direction of the conductive heat transfer in the heat exchanger of FIG. 4 is across the thickness of the fin. The differences in effective fin heights are set forth in the Figures.

Conductive heat sink fin efficiency $N_{FIN}$ can be represented as follows:

$$Q=N_{FIN}(h_c)(A)(\Delta T)$$

where

Q=Heat Flow (BTU/hr)

$h_c$=Convective Coefficient

A=Convective surface area of the Fin ($Ft^2$)

ΔT=Temperature differential between base of Fin to surrounding fluid $$N_{FIN} = \frac{\tanh(ml)}{(ml)}$$

where $$m=\sqrt{(h_c)(P)/KA}$$

Tanh=hyperbolic tangent $h_c$=Convective Coefficient

P=Perimeter of fin cross-section

K=Thermal conduction of fin material

A=Fin cross sectional area

L=Conductive length across material*

*The present invention uses the fin thickness (approximately 0.006 inch) instead of the fin height. Fin height can exceed 1.5 inches as the conductive length, thereby maximizing fin efficiency.

Convection heat transfer can be represented by the following formula:

$$Q=(h_c)(A)(\Delta T)$$

where

Q=Heat Flow (BTU/hr) Ideal $h_c$=convective heat transfer coefficient (BTU/(hr)($ft^2$)(F°)

A=effective surface area exposed to air for convection heat transfer ($Ft^2$)

ΔT=Surface/Air temperature differential F°

Deriving $h_c$ is complex and dependent on the fluid viscosity and duct geometry which in turn affects such terms as the Reynolds No., Nusselt No., Prandl No., Stanton No. Grashoff No., Biot No., and the Fourier No. The application of the present invention is independent of the convection coefficient and related terms.

Conduction heat transfer can be represented as follows:

$$Q = \frac{(K)(A)(DT)}{L}$$

where

Q=Heat Flow (BTU/hr)

K=Thermal Conductivity of the material (BTU/(hr)(ft$^2$)(F°)

ΔT=Temperature differential across material (F°)

L=Conductive Length across material (Ft)

Fin efficiency is the ratio of actual heat loss from the fin to the ideal heat loss if the entire fin was at the base temperature.

Figure 5:
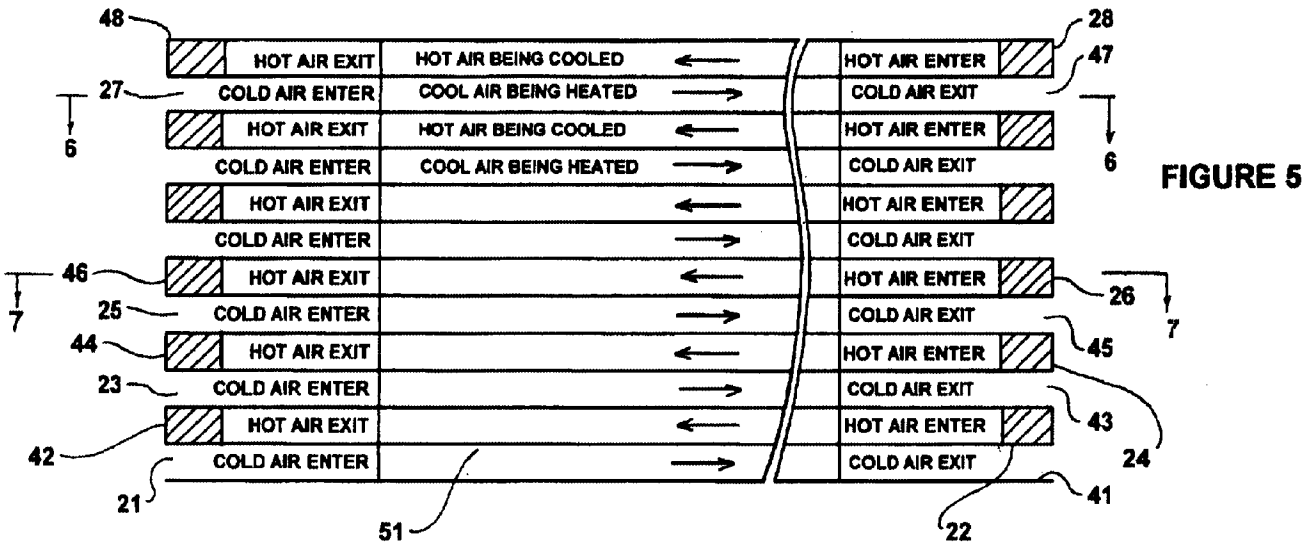
FIG. 5 shows the flow of air in the counterflow heat exchanger of FIGS. 2 and 4.

FIG. 5 shows the arrangement of the cold and hot air passages in more detail. There are a plurality of cold air intake passages 21, 23, 25, 27, etc., and corresponding cold air exits 41, 43, 45, and 47, etc. It will be appreciated that the number and length of the passages can vary depending on the user's needs. Generally, in the vicinity of the cold air exits there will be a plurality of hot air intake passages 22, 24, 26, 28, etc., that typically correspond in number to the number of cold air intake passages. Preferably each hot air intake passageway has a cold air passageway on both sides thereof. Each hot air intake passage has an upper and a lower surface connecting by two opposing sidewalls. The corresponding hot air exits 42, 44, 46, and 48 are generally located in the vicinity of the cold air intake passages.

Figure 6:
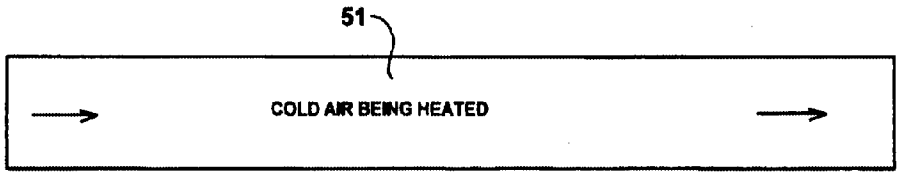
FIG. 6 shows the cross section of the heat exchanger of FIG. 5 taken along A—A (Exchange air flow).

As hot air enters the hot air intake passages the heat from the hot air is transferred by the heat exchanger through the fin wall 51 to the cold air in the cold air passageway. This increases the temperature of the cold air and reduces the temperature of the hot air. As the hot air passes through the passage the temperature is reduced due to the cold air in the cold air passageway. As seen in FIG. 6, the colder air $T_{cold\ min}$ is at the entrance of the cold air passageway and the warmer cold air $T_{coldmax}$ is at the exit. It will be understood by those skilled in the art that the term air is not limited to air but can include any fluid medium that is typically used in a heat exchanger for the transfer of heat. Also, it should be noted that the terms cold and hot are relative terms. Typically the cold air may be colder than the hot air but the degree of temperature difference between the two can vary as desired for the circumstances.

Figure 7:
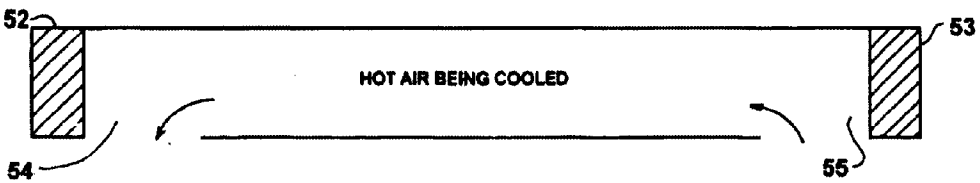
FIG. 7 shows the cross section of the heat exchanger of FIG. 5 taken along B—B (Conditioned air flow).

FIG. 7 is shows one embodiment of the heat exchanger of the present invention. In this embodiment, the hot air enters and exits the heat exchanger at generally right angles to the cold air intake and exit. Plugs 52 and 53 in the passageway divert the hot air through side passages 54 and 55. Side passages 54 and 55 are preferably just cut outs in the sidewall of the fins. In another embodiment the hot air and cold air do not enter and exit perpendicular to each other but rather parallel to each other.

Figure 8:
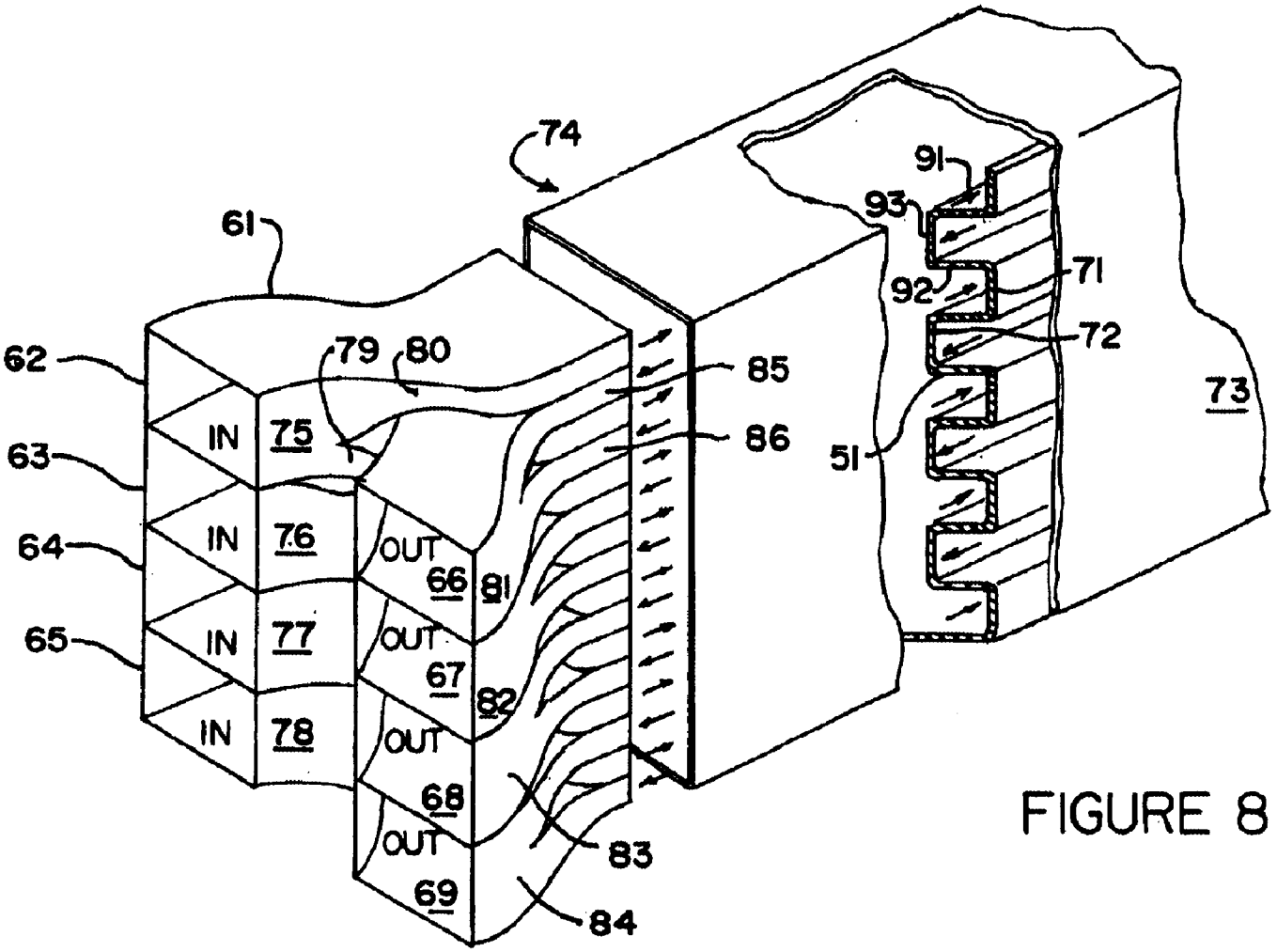
FIG. 8 shows an example of an alternative embodiment of the heat exchanger of FIG. 5.
Figure 9:
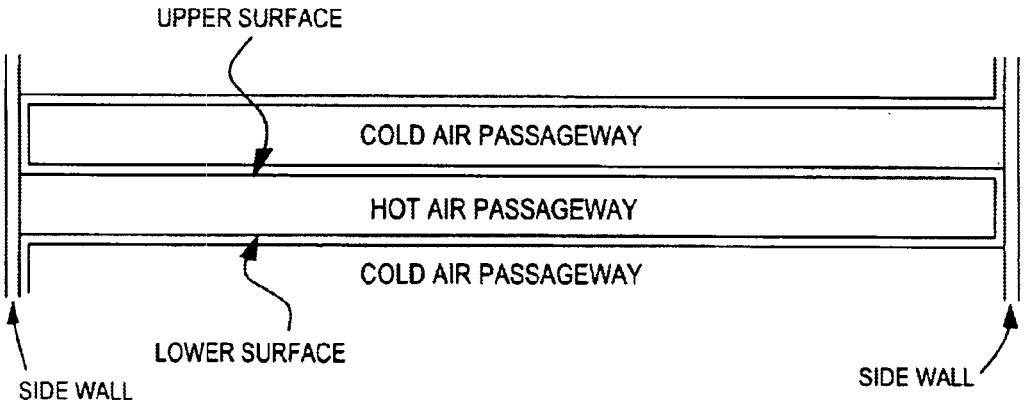
FIG. 9 shows a cross section of the heat exchanger of FIG. 4.

FIG. 8 shows a second embodiment of the present invention. In this embodiment, the hot air does not enter and exit at right angles to the cold air. A split manifold 61 has a plurality of entranceways 62, 63, 64, 65, etc. and exits 66, 67, 68, 69, etc, at each end. The number of entranceway can vary as desired. For simplicity, FIG. 8 shows the cold air intake end and the hot air exit. It will be appreciated by those skilled in the art that the opposite end where there is the hot air intake and the cold air exit can be similarly constructed. The use of the split manifold eliminates the need for the plugs and the sidewall cutouts discussed above. The manifold 61 is adjacent to the heat exchanger and directs the air into the appropriate passageways. FIG. 8 also shows the configuration of the corrugated fin that forms with the sidewalls the passageways for the transport of the hot and cold air. As seen in FIG. 8 the fins have a series of alternating peaks 71 and valleys 72 on each side of the fin walls 51. The peaks and valleys have fin sidewalls 91 and 92 that are separated by fin base 93. The fin sidewalls are preferably generally at right angles to the fin base 93. Heat exchanger sidewalls 73 and 74 close the open ends of the peaks and valleys of the fins to form the passageways. These passageways are preferably generally rectangular although other configurations are possible.

In the split manifold that is preferred for use with the heat exchanger of the present invention the plurality of entranceways 62, 63, 64, 65. Each of the intake passages 75, 76, 77, and 78 extending from the entranceways of the manifold split into two or more intake sections 79 and 80. Exits 66, 67, 68 and 69 have outflow passages 81, 82, 83 and 84 extending from the exits. Each of these outflow passages similarly split into two or more outflow sections 85 and 86 such that section 85 extends between sections 79 and 80. Section 79 extends between sections 85 and 86. Thus, except for the uppermost and lowermost passageways, each cold air passage has an upper and a lower hot air passage adjacent to opposite sides thereof. Similarly, each hot air passage has an upper and a lower cold air passage adjacent to opposite sides thereof.

Although the Figures show generally rectangular intake and outflow sections it will be appreciated that other configurations are possible. It is preferred that when rectangular intake and outflow sections are used, the longer sides of the rectangle are the sides that provide the heat transfer surface. Similarly, the passageways formed by the corrugated fins should also have a wider portion as the contact surface between the hot and cold air. The greater of area of contact between the hot air and the cold air, the more efficient the heat exchanger.

I claim:

1. A counterflow heat exchanger comprising cold air intake passageways and hot air intake passageways wherein the flow of cold air is opposite the flow of hot air and wherein each cold air intake passageway contacts at least one hot air intake passage way;

wherein each hot air intake passageway has an upper surface and a lower surface and at least one hot air intake passageway has a cold air intake passageway in contact with each of said upper and lower surfaces;

wherein there is a split manifold, said the split manifold comprising a plurality of entranceways and exits, each said entranceways having an intake passage extending therefrom and each of said exits having an outflow passage extending therefrom, said intake passage splitting into two or more intake sections and each of said outflow passages splitting into two or more outflow sections.

2. The heat exchanger according to claim 1 wherein each hot air intake passageway has an upper surface and a lower surface and at least one hot air intake passageway has a cold air intake passageway in contact with each of said upper and lower surfaces.

3. The heat exchanger according to claim 2 wherein each hot air intake passageway has a pair of opposing sidewalls connecting said upper and lower surfaces.

4. The heat exchanger according to claim 3 wherein each of said upper and lower surfaces have a surface area greater than the surface area of each of said sidewalls.

5. The heat exchanger according to claim 4 wherein each of said hot air passageway exhausts the air exiting said passageway perpendicular to the flow of cold air in the cold air intake passageways.

6. The heat exchanger according to claim 2 wherein said passageways are formed from a corrugated fin.

7. The heat exchanger according to claim 6 wherein the corrugated fin forming said passageways forms three sides of said passageways.

8. The heat exchanger according to claim 7 wherein said passageways have a fourth side formed from a heat exchanger sidewall.

9. The heat exchanger according to claim 1 wherein one or more outflow sections have a top surface and a bottom surface and there is a intake section on each of said surfaces and wherein one or more intake sections have a top surface and a bottom surface and there is a outflow section on each of said surfaces.

10. The heat exchanger according to claim 1 wherein the height of the corrugated fin to the width of the corrugated fin is at least 10:1.

11. A counterflow heat exchanger comprising cold air intake passageways and hot air intake passageways wherein the flow of cold air is opposite the flow of hot air and wherein each cold air intake passageway contacts at least one hot air intake passage way and wherein said cold air is released from said heat exchanger from a plurality of cold air exits and said hot air is released from said heat exchanger from a plurality of hot air exits;

wherein said heat exchanger further comprising a split manifold;

wherein the split manifold comprises a plurality of entranceways and exits, each said entranceways having an intake passage extending therefrom and each of said exits having an outflow passage extending therefrom, said intake passage splitting into two or more intake sections and each of said outflow passages splitting into two or more outflow sections.

12. A counterflow heat exchanger comprising cold air intake passageways and hot air intake passageways wherein each cold air intake passageway contacts at least one hot air intake passage way and wherein said cold air is released from said heat exchanger from a plurality of cold air exits and said hot air is released from said heat exchanger from a plurality of hot air exits;

wherein said heat exchanger further comprising a split manifold;

wherein the split manifold comprises a plurality of entranceways and exits, each said entranceways having an intake passage extending therefrom and each of said exits having an outflow passage extending therefrom, said intake passage splitting into two or more intake sections and each of said outflow passages splitting into two or more outflow sections.

* * * * *